United States Patent [19]

Akiyama et al.

[11] Patent Number: 4,504,215

[45] Date of Patent: Mar. 12, 1985

[54] LIQUID FUEL BURNER

[75] Inventors: Junichiro Akiyama; Mitsuhiro Tanaka; Yoshihisa Moriuchi, all of Shizuoka, Japan

[73] Assignee: Nippon Gakki Seizo Kabushiki Kaisha, Japan

[21] Appl. No.: 433,147

[22] Filed: Oct. 6, 1982

[30] Foreign Application Priority Data

| | | | |
|---|---|---|---|
| Oct. 9, 1981 | [JP] | Japan | 56-161388 |
| Oct. 9, 1981 | [JP] | Japan | 56-161389 |
| Oct. 9, 1981 | [JP] | Japan | 56-150264[U] |

[51] Int. Cl.[3] ..... F23D 11/06

[52] U.S. Cl. ..... 431/168; 431/169

[58] Field of Search ..... 431/168, 169; 239/214.11, 214.17, 214.25, 223

[56] References Cited

U.S. PATENT DOCUMENTS

| | | | |
|---|---|---|---|
| Re. 19,785 | 12/1935 | Powers | 431/169 |
| 1,707,474 | 4/1929 | Heath | 431/168 |
| 2,039,937 | 5/1936 | Schroeder | 431/168 |
| 2,249,878 | 7/1941 | Asbury | 431/168 |
| 3,127,924 | 4/1964 | Down | 431/168 |
| 3,176,749 | 4/1965 | Down | 431/168 |
| 3,811,818 | 5/1974 | Miyahara | 431/168 |
| 3,844,705 | 10/1974 | Miyahara | 431/168 |
| 3,874,840 | 4/1975 | Miyahara | 431/168 |
| 3,892,518 | 7/1975 | Miyahara | 431/168 |
| 4,022,567 | 5/1977 | Miyahara | 431/168 |
| 4,113,421 | 9/1978 | Miyahara | 431/168 |
| 4,247,282 | 1/1981 | Miyahara | 431/168 |
| 4,395,228 | 7/1983 | Bazarov et al. | 431/168 |

FOREIGN PATENT DOCUMENTS

| | | | |
|---|---|---|---|
| 0102605 | 8/1981 | Japan | 431/168 |

*Primary Examiner*—Samuel Scott
*Assistant Examiner*—Helen A. Odar
*Attorney, Agent, or Firm*—Lerner, David, Littenberg, Krumholz & Mentlik

[57] ABSTRACT

In the construction of a liquid fuel burner in which liquid fuel is subjected to two-staged combustion, active and passive expedients are preferably combined for complete burning of the liquid fuel. The active expedient employs specified edge construction of a fuel scatter ring for production of ideally atomized fuel whereas the passive expedient employs a barrier construction arranged at the open front end of a combination cylinder for effective prevention of fuel drop causable of incomplete fuel burning.

15 Claims, 16 Drawing Figures

LIQUID FUEL BURNER

BACKGROUND OF THE INVENTION

The present invention relates to an improved liquid fuel burner, and more particularly relates to an improvement for complete fuel burning in a burner in which liquid fuel such as kerosene is subjected to two-staged combustion.

As is well known, a liquid fuel burner includes an air supply duct, a fuel supply line, a fuel carburetor, a scatter ring coupled to the fuel carburetor for pulverization of liquid fuel and a perforated combustion cylinder defining internally a combustion chamber and externally a gas chamber.

In operation, supplied liquid fuel flows, in a thin layer form, along the inner wall of the fuel carburetor towards the scatter ring which by its high speed rotation pulverizes the liquid fuel for production of atomized fuel. Mixture of the atomized fuel with fresh air supplied through the air supply duct is ignited in the combustion chamber for primary combustion. This primary combustion heats the fuel carburetor for evaporation of the liquid fuel therein and fuel-air mixture is subjected to secondary combustion in the combustion chamber after passage through the gas chamber surrounding the perforated combustion cylinder.

Burning condition of the liquid fuel is subtly swayed by various factors, and delicate adjustment of these factors is necessary for complete burning of the fuel in the burner. First, it is required for the liquid fuel to form a thin and uniform layer on the inner wall of the fuel carburetor in order to enable sufficient pulverization for the primary combustion and rich and swift evaporation for the secondary combustion. Secondly, the scatter ring is required to have a function to produce highly atomized fuel and distribute the atomized fuel over broad area on the inner wall of the combustion cylinder.

In order to suffice these requirements, it was proposed to provide a scatter ring with an indented peripheral edge by, for example, forming radial cutouts in the edge. This proposed construction, however, cannot well avoid local shortage of air in the combustion chamber due to its rather poor air drag, thereby causing generation of a great deal of soot on the outer wall of the fuel carburetor.

Thirdly fuel drop in the burner forms a serious bar to complete burning of the fuel. The first fuel drop is caused by concentration of the liquid fuel on the outer wall of the air supply duct which is constantly cooled by supply of fresh air. Ths second fuel drop takes place at the open front end of the combustion cylinder. Such fuel drop is quite unavoidable in practice.

SUMMARY OF THE INVENTION

It is the primary object of the present invention to promote complete fuel burning in a liquid fuel burner.

It is another object of the present invention to enable ideal pulverization of liquid fuel and broad uniform distribution of atomized fuel.

It is a further object of the present invention to attain rich mixing of atomized fuel with fresh air.

It is a still further object of the present invention to remove ill influences to be caused by unavoidable fuel concentration.

In accordance with the basic aspect of the present invention, a liquid fuel burner contains a scatter ring provided with scatter guides and intervening cutouts, the scatter guides protrude radially from the outermost conical wall of the scatter ring, and each cutout is arranged between adjacent scatter guides.

In accordance with another aspect of the present invention, a liquid fuel burner contains a combustion cylinder provided with at least one barrier unit which is arranged at the front end of the combustion cylinder.

DESCRIPTION OF THE PREFERRED EMBODIMENTS

Figure 1:
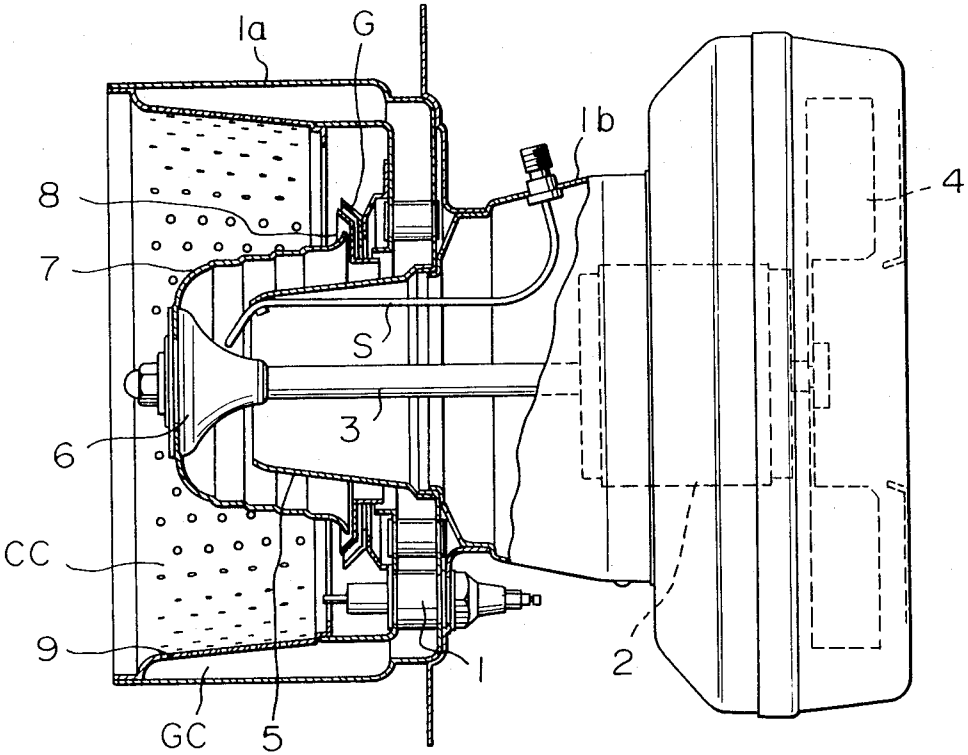
Fig. 1 PRIOR ART
FIG. 1 is a side view, partly in section, of a typical conventional liquid fuel burner.

One typical example of the conventional liquid fuel burner is illustrated in FIG. 1, in which the liquid fuel burner includes a hollow cylindrical main body made up of a front main body 1*a* and a hollow specially configurated rear main body 1*b* which is secured to the rear end of the front main body 1*a*. A drive motor 2 is substantially concentrically encased within the rear main body 1*b*. A main shaft 3, which is one output shaft of the drive motor 2, extends centrally and axially forwards in the front main body 1*a* whereas a blower fan 4 is connected to the other output shaft of the drive motor 2 for supply of fresh air to the combustion system. A hollow conical air supply duct 5 is coupled to the front end of the rear main body 1*b* and axially extends forwards in the front main body 1*a* whilst spatially surrounding the main shaft 3. This air supply duct 5 is open on both ends.

A conical fuel diffuser 6 is coupled to the front end of the main shaft 3 and divergingly extends forwards outside the air supply duct 5 in an arrangement to leave an annular gap between its curved surface and the front end of the air supply duct 5. The fuel diffuser 6 securedly carries a hollow conical fuel carburetor 7 which extends rearwards whilst spatially surrounding the air supply duct 5 in the front main body 1*a*. The rear end of the fuel carbureter 7 is accompanied with a scatter ring 8 which is given in the form of a shallow plate slightly diverging forwards outside the fuel carburetor 7. The scatter ring 8 is locally secured to the rear end of the fuel carburetor 7 by means of, for example, spot welding. Due to this local connection narrow gaps G are left between the rear end of the fuel carburetor 7 and the front face of the scatter ring 8, which are in general called "scattering gaps".

A hollow, perforated combustion cylinder 9 is concentrically and securedly arranged within the front main body 1*a* whilst spatially surrounding the fuel carburetor 7 and the scatter ring 8. This combustion cylinder 9 internally defines a combustion chamber CC and externally defines a gas chamber GC.

A fuel supply line S is coupled to the rear main body 1*b* and extends forwards in the air supply duct 5. This fuel supply line is connected to a given supply source of fuel (not shown) and terminates in the proximity of the curved surface of the fuel diffuser 6. Further, an ignition plug I is secured to the front main body 1*a* whilst projecting into the combustion chamber CC formed by the combustion cylinder 9.

In operation of the above-described liquid fuel burner, the fresh air is supplied to the combustion system by operation of the blower fan 4 and the liquid fuel via the fuel supply line S. More specifically, stream of fresh air under pressure is supplied through the air supply duct 5 into the interior of the fuel carburetor 7. Concurrently, part of the air flows into the gas chamber GC between the combustion cylinder 9 and the front main body 1*a*. The liquid fuel from the fuel supply line S impinges upon the curved surface of the fuel diffuser 6 and high speed rotation of the fuel diffuser 6 supplies the liquid fuel onto the inner wall of the fuel carbureter 7 in a thin layer form. The liquid fuel is then blown out through the scattering gaps G of the scatter ring 8 due to centrifugal force generated by high speed rotation of the fuel carburetor 7. Thus, the liquid fuel is pulverized and atomized fuel particles are scattered onto the inner wall of the combustion cylinder 9.

By operation of the ignition plug I, the fuel is ignited to cause combustion of the atomized liquid fuel. This primary combustion heats the fuel carburetor 7 to evaporate the liquid fuel forming the thin layer on its inner wall. Mixture of the evaporated fuel with the air is supplied into the gas chamber GC and blown into the combustion chamber CC for secondary combustion.

As briefly remarked already, this conventional two staged combustion does not assure complete burning of the liquid fuel and often causes undesirable oil drop along the combustion cylinder 9.

Figure 2:
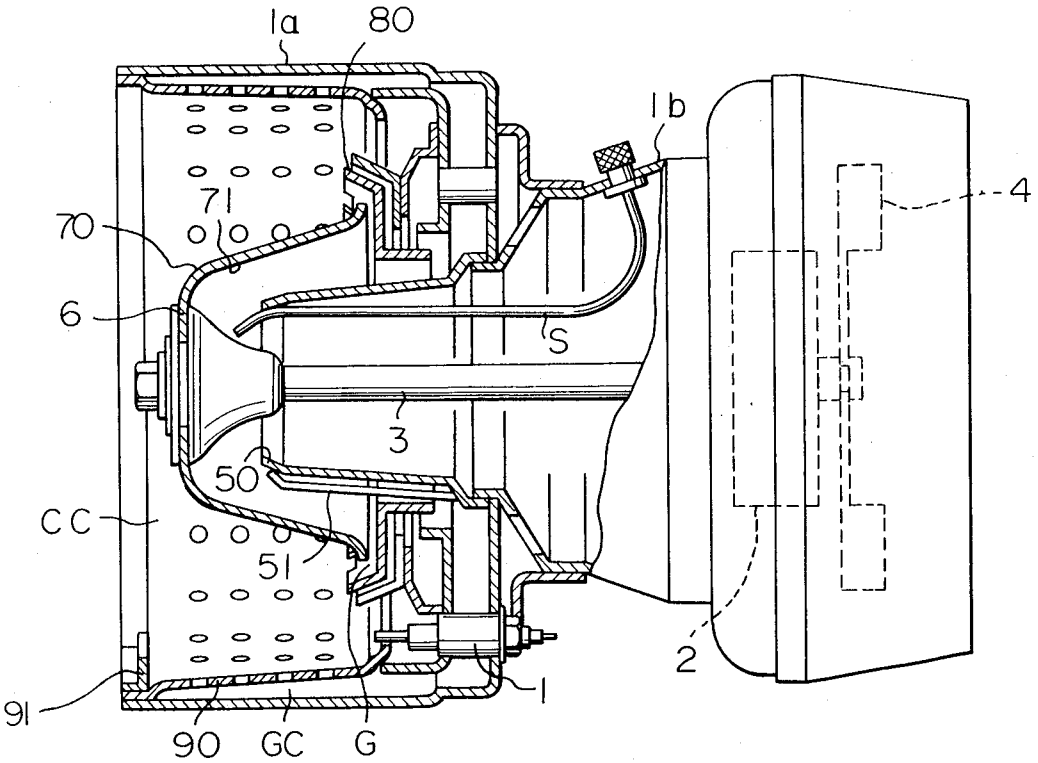
FIG. 2 is a side view, partly in section, of one embodiment of the liquid fuel burner in accordance with the present invention.

One embodiment of the liquid fuel burner in accordance with the present invention is shown in FIG. 2, in which parts substantially same in construction and operation as those used in the conventional liquid fuel burner shown in FIG. 1 and indicated with same reference symbols.

Like the conventional arrangement, the liquid fuel burner in accordance with the present invention includes a front main body 1*a*, a rear main body 1*b*, a drive motor 2, a main shaft 3, a blower fan 4, and air supply duct 50, a fuel diffuser 6, a fuel carburetor 70, a scatter ring 80, a combustion cylinder 90, a fuel supply line S and an ignition plug I. The combustion cylinder 90 defines internally a combustion chamber CC and externally a gas chamber GC.

As the drive motor 2 rotates, the fuel diffuser 6 and the fuel carburetor 70 are driven for high speed rotation and the liquid fuel from the fuel supply line S is supplied towards the inner wall 71 of the fuel carburetor 70 to form a thin layer which flows towards the rear end of the fuel carburetor 70. A number of scattering gaps G are formed at the rear end of the fuel carburetor 70 and, upon arrival at the rear end, the liquid fuel flows onto the inner wall of the scatter ring 80 via the scattering gaps G. The scattering edge of the scatter ring 80 tears the liquid fuel layer into a number of fine particles and the atomized fuel particles are scattered onto the inner wall of the perforated combustion cylinder 90. Primary combustion of the fuel by operation of the ignition plug I heats the fuel carburetor 70 to evaporate the fuel within the fuel carburetor 70. The evaporated fuel is then mixed with the fresh air introduced into the combustion chamber CC and the mixture of the evaporated fuel with the fresh air is subjected to secondary combustion within the combustion chamber CC. Preferably, the wall thickness of the carburetor is in a range from 0.6 to 1.0 mm.

For ideal pulvarization of the fuel at the edge of the scatter ring 80, the liquid fuel is required to form a very thin, uniform layer on the inner wall of the fuel carburetor 70. To this end, the fuel carburetor 70 in accordance with the present invention is preferably provided with a smooth inner wall 71. Absence of annular steps on the inner wall of the fuel carburetor 70 enables ideal formation of a very thin, uniform fuel layer and continuous smooth flow of the fuel layer towards the rear end of the fuel carburetor 70. The thin, uniform and continuous construction of the fuel layer causes ideal pulverization of the fuel by the scatter ring 80.

The scatter ring 80 is expected to have two major functions, one being pulverization of the liquid fuel and the other being introduction of fresh air into the combustion chamber CC. It is further required for better primary combustion within the combustion chamber CC that the atomized fuel should be uniformly distributed over a broad area on the inner wall of the combustion cylinder 90.

Figure 3A:
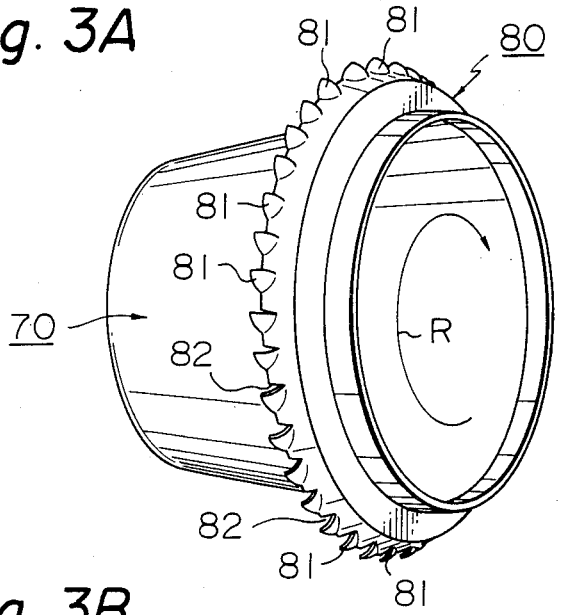
FIGS. 3A and 3B are perspective and front end views of an embodiment of the scatter ring advantageously usable for the liquid fuel burner shown in FIG. 2, FIGS. 4 to 6 are perspective views of other embodiments of the scatter ring advantageously usable for the liquid fuel burner shown in FIG. 2, FIGS. 7A and 7B are transverse and side sectional views of one embodiment of the fuel guide unit advantageously usable for the liquid fuel burner shown in FIG. 2, FIGS. 8A and 8B are transverse and side sectional views of another embodiment of the fuel guide unit advantageously usable for the liquid fuel burner shown in FIG. 2, FIGS. 9A and 9B are transverse and side sectional views of a further embodiment of the fuel guide unit advantageously usable for the liquid fuel burner shown in FIG. 2.
Figure 3B:
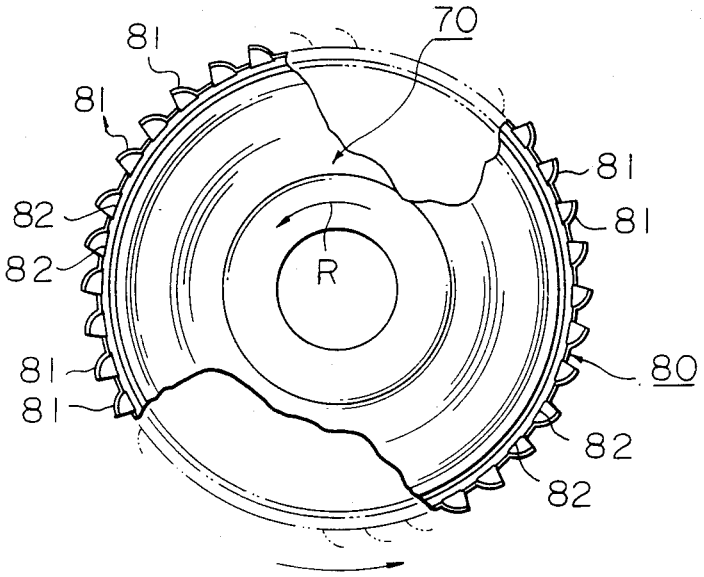

One embodiment of the present invention to suffice those requirements is shown in FIGS. 3A and 3B, in which the scatter ring 80 is provided at its edge with a number of scatter guides 81. Each scatter guide 81 takes the form of a nail raised outwards from the edge of the scatter ring 80 and directed in the rotational direction of the scatter ring 80. Adjacent scatter guides 81 are intervened by a cutout 82. For example, 36 scatter guides 81 are provided on the edge of the scatter ring with 36 cutouts 82. The number of the scatter guide 81, however, can be adjusted as required in view of the actual condition of burning. Although the scatter guides 81 should be arranged on the edge of the scatter ring 80 preferably at equal intervals, they may also be gathered locally at several sections on the edge of the scatter guide.

As the scatter ring 80 rotates in the direction of an arrow R, the liquid fuel in the layer form flows through the cutouts 82 and guided by the scatter guides 81 to be pulverized and distributed over the broad area on the inner wall of the combustion cylinder 90. Concurrently with this, the scatter guides 81 drag in increased amount of fresh air into the combustion chamber CC to promote mixing of the atomized fuel with the fresh air for better burning at the primary combustion. Further, circumferential movement of the scatter guides 81 having the specific, three-dimensional construction generates a quick flow of the fresh air within the combustion chamber CC. In other words, a sort of air curtain is formed around the fuel carburetor 70 which is cylindrical or vortical about the axis of rotation. Such as cylindrical or voritcal air curtain well hinders sticking of the pulverized fuel onto the outer wall above the fuel carburetor 70 and assures complete burning of the fuel without the production of soot. Apparently, abrupt and complete burning at the primary combustion significantly reduces the possibility of undesirable fuel drop in the combustion cylinder 90.

Figure 4:
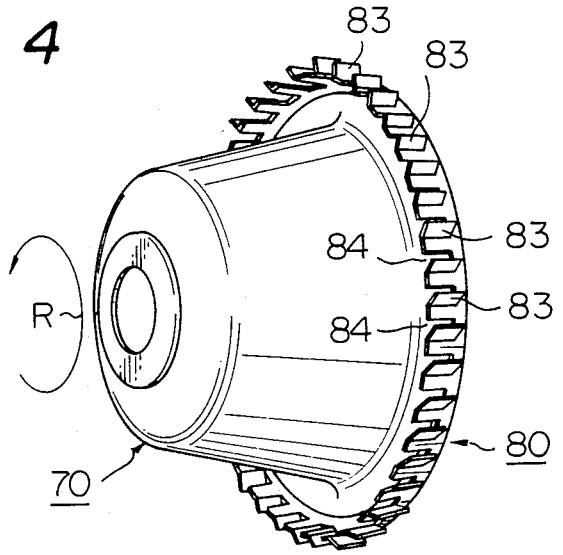
Figure 5:
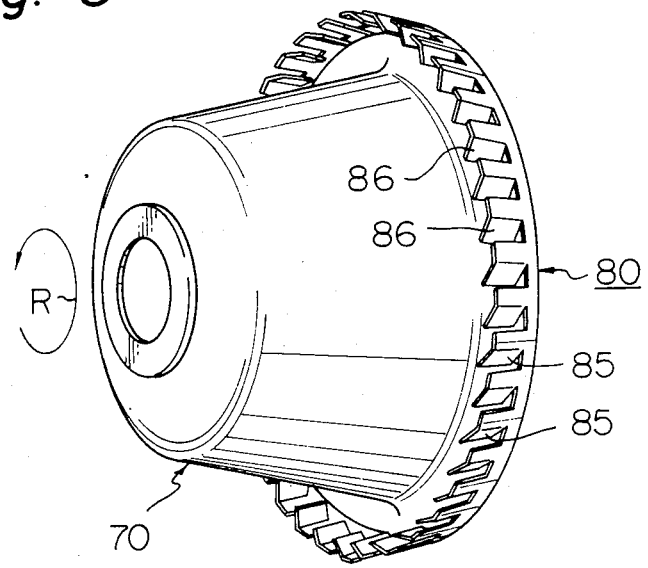
Figure 6:
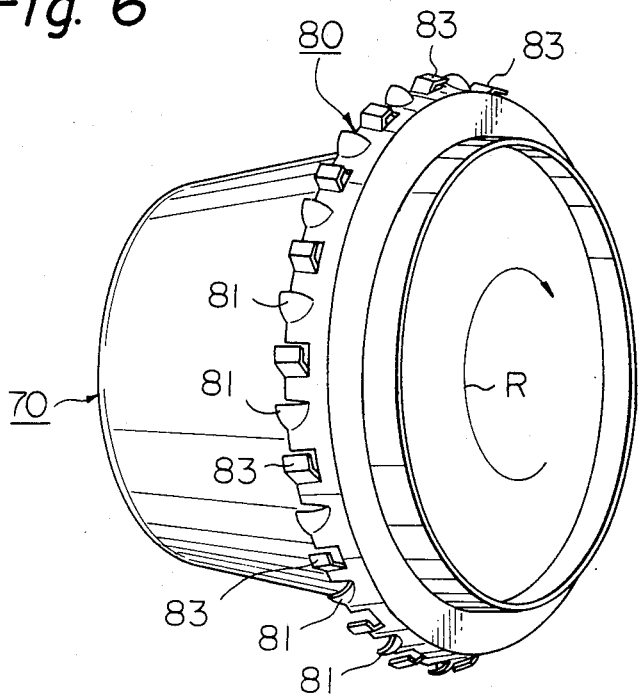

Another preferred embodiments of the scatter ring in accordance with the present invention are shown in FIGS. 4 to 6.

In the construction shown in FIG. 4, the scatter ring 80 is provided with a number of rectangular scatter guides 83 intervened by cutouts 84. Each scatter guide 83 is given in the form of a rectangular piece which is formed by radially indenting the edge of the scatter ring 80, raising the section between adjacent indentations and twisting the raised section outwards preferably in the direction of the tangent at that point of the edge. Such scatter guides 83 may be made separately from the scatter ring 80 and attached to the edge of the scatter ring 80 by means of, for example, spot welding so that each should radially extend outwards in the local tangential direction.

In the construction shown in FIG. 5, the scatter ring 80 is provided at its edge with a number of rectangular scatter guides 85 each extending inwards preferably in the direction of the tangent at that point of the edge. The scatter guide 85 are intervened by rectangular cutouts 86.

In the construction shown in FIG. 6, the scatter ring 80 is provided at its edge with a number of scatter guides 81 shown in FIGS. 3A and 3B and a number of scatter guides 83 shown in FIG. 4 in an alternate arrangement. The alternate arrangement may also given in the form of a combination of the scatter guides 81 shown in FIGS. 3A and 3B with the scatter guides 85 shown in FIG. 5, or a combination of the scatter guides 83 shown in FIG. 4 with the scatter guides 85 shown in FIG. 5. In any case, the alternate arrangement of different scatter guides causes better pulverization of the liquid fuel and richer introduction of fresh air into the combustion chamber CC.

During continuous fuel burning based on the two-staged combustion, blue flames are observed in the liquid fuel burner, which indicates complete burning of the supplied liquid fuel. However, yellow flames are occasionally generated during the continuous fuel burning in the burned by dew concentration of the fuel in the fuel carburetor 70 on the outer wall of the air supply duct 50 which is constantly cooled by the fresh air passing therethrough. The fuel so accumulated on the outer wall of the air supply duct 50 finally drops onto the inner wall of the fuel carburetor 70 and disturbes uniformity of the thin fuel layer already on the inner wall. This naturally causes aggravated pulverization of the liquid fuel by the scatter ring 80 and generation of yellow flames within the combustion chamber CC, which indicates incomplete burning of the liquid fuel. Even when the fuel carburetor 70 is provided with the smooth inner wall 71 and/or the scatter ring 80 is provided with the scatter guides 81, 83 and 85 in accordance with the preceding embodiments of the present invention, such generation of yellow flames is unavoidable as long as the air supply duct 50 is cooled by constant passage of fresh air.

In a preferred embodiment of the present invention, the fuel concentrated on the outer wall of the air supply duct 50 is introduced into the gas chamber GC for evaporation in order to prevent generation of yellow flames. More specifically, as shown in FIG. 2, the air supply duct 50 is provided on its lower side with a fuel guide unit 51 which extends axially along the outer wall of the air supply duct 50.

Figure 7A:
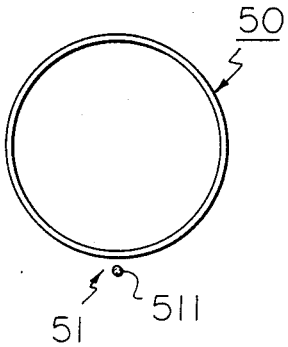
Figure 7B:
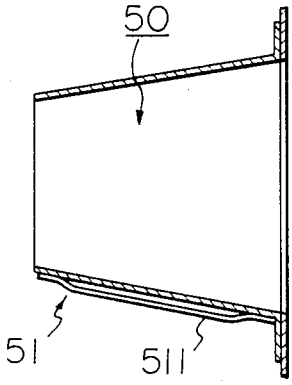
Figure 8A:
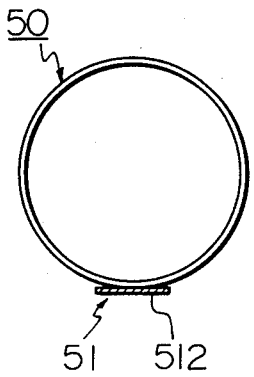
Figure 8B:
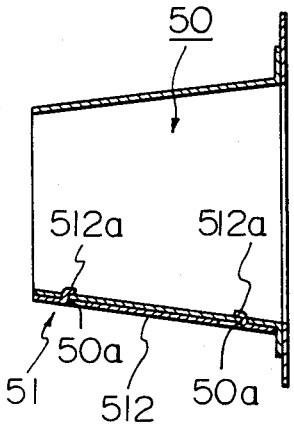
Figure 9A:
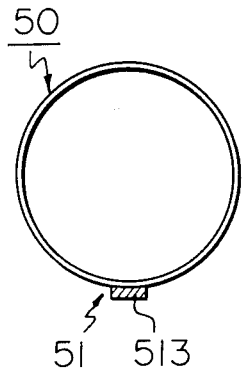
Figure 9B:
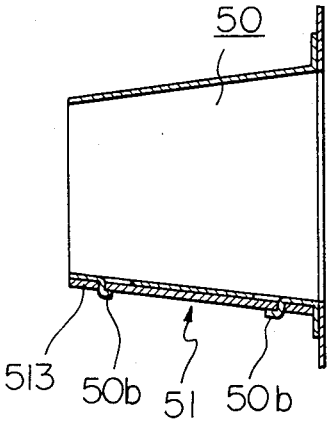

In the case of the embodiment shown in FIGS. 7A and 7B, the fuel guide unit 51 takes the form of a refractory metallic wire 511 which is welded at both ends to the outer wall of the air supply duct 50 whilst leaving a slight gap around the outer wall. The fuel guide unit 51 shown in FIGS. 8A and 8B is given in the form of a refractory metallic strap 512 which is provided with raised hooks **512*a* to be received in corresponding slits 50*a* formed through the wall of the air supply duct 50. Further in the case of the construction shown in FIGS. 9A and 9B, the fuel guide unit 51 takes the form of an absorbent strap 513 which is held by holder hooks 50*b* raised from the wall of the air supply duct 50**.

With the above-described construction of the fuel guide unit 51, attached to the air supply duct 50, the liquid fuel concentrated on the outer wall of the air supply duct 50 flows rearwards along the fuel guide unit 51. Upon arrival at the rear end of the air supply duct 50, the liquid fuel is introduced into the gas chamber GC outside the combustion cylinder 90 for evaporation therein.

Since the liquid fuel concentrated on the outer wall of the air supply duct 50 is removed outside the fuel carburetor 70 by operation of the fuel guide unit 51, no generation of yellow flames occurs in the combustion chamber CC and complete burning of the supplied fuel is expected.

Despite the foregoing expedients in accordance with the present invention, there is still a possibility of fuel drop from the open front end of the combustion cylinder 90 since the mode of fuel burning in the liquid fuel burner is more or less swayed by subtle change in process factors such as air supply, fuel supply, high speed rotation and pulverization.

In accordance with a further preferred embodiment of the present invention, such fuel drop is blocked by a barrier unit 91 arranged at the open front end of the combustion cylinder 90 as shown in FIG. 2.

Figure 10:
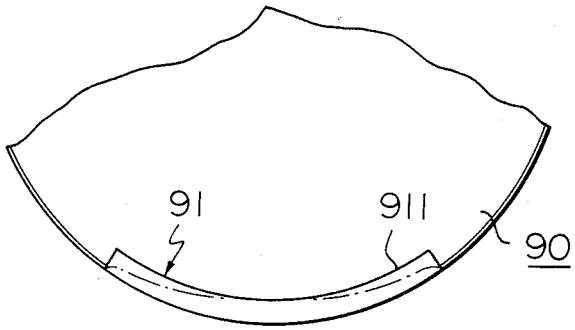
FIG. 10 is a fragmentary front view of the combustion cylinder provided with one embodiment of the barrier unit in accordance with the present invention.

In the case of the embodiment shown in FIG. 10, the barrier unit 91 takes the form of an arcuate barrier 911 attached to the lower front edge of the combustion cylinder 90. The liquid fuel flowing towards the front edge along the inner wall of the combustion cylinder 90 is blocked by the barrier 911 arranged at the edge and subjected to the primary combustion. The height of the barrier 911 may either be uniform over its entire length as shown with solid lines or diminished on distal ends as shown with chain lines.

Figure 11:
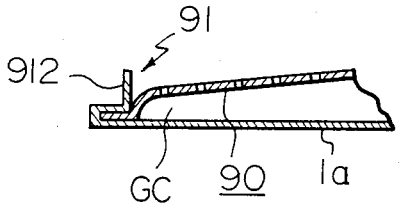
FIGS. 11 and 12 are fragmentary side sectional views of the combustion cylinder provided with other embodiments of the barrier unit in accordance with the present invention.

As a substitute for the separate barrier 911 coupled to the front edge of the combustion cylinder 9 shown in FIG. 10, the barrier unit 91 shown in FIG. 11 includes an arcuate bent front edge 912 of the front main body **1*a* which projects radially inwards and embraces the front edge of the combustion cylinder 90**.

Figure 12:
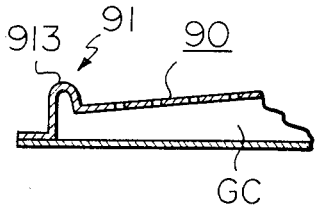

A further modification is shown in FIG. 12, in which the barrier unit 91 is given in the form of an arcuate bulge 913 formed at the front edge of the combustion cylinder 90 which projects radially inwards.

Instead of the arcuate constructions shown in the drawings, the barrier unit 91 may extend over the entire periphery of the front edge of the combustion cylinder 90. Further, two or more separate barrier units 91 may be arranged at positions along the periphery of the front edge of the combustion cylinder 90.

We claim:

1. An improved liquid fuel burner comprising a hollow cylindrical main body, a rotary main drive shaft concentrically arranged in said main body, an air supply duct coupled to said main body and spatially surrounding said main drive shaft, a conical fuel carburetor coupled to the front end of said main drive shaft and specifically surrounding said air supply duct, said carburetor having an inner surface and an open end arranged rearwardly surrounding said air supply duct, a plate-like scatter ring coupled to the rear end of said fuel carburetor whilst leaving scatter ring gaps for passage of liquid fuel, said scatter ring being provided with alternately arranged scatter guides and cutouts, said scatter guides protruding radially outward from the outermost conical wall of said scatter ring, a hollow perforated combustion cylinder coupled to said main body and defining internally a combustion chamber around said fuel carburetor and externally a gas chamber surrounded by said main body, means for supplying said liquid fuel to said combustion chamber along the inner surface of said carburetor and into contact with said scatter guides for pulverization of said liquid fuel, and means for supplying fresh air to said combustion chamber.

2. An improved liquid fuel burner comprising a hollow cylindrical main body, a rotary main drive shaft concentrically arranged in said main body, an air supply duct coupled to said main body and spatially surrounding said main drive shaft, a conical fuel carburetor coupled to the front end of said main drive shaft and specifically surrounding said air supply duct, said carburetor having an inner surface and an open end arranged rearwardly surrounding said air supply duct, a plate-like scatter ring coupled to the rear end of said fuel carburetor whilst leaving scatter ring gaps for passage of liquid fuel, said scatter ring being provided with alternately arranged scatter guides and cutouts, said scatter guides protruding radially outward from the outermost conical wall of said scatter ring, a hollow perforated combustion cylinder coupled to said main body and defining internally a combustion chamber around said fuel carburetor and externally a gas chamber surrounded by said main body, means for supplying said liquid fuel to said combustion chamber along the inner surface of said carburetor and into contact with said scatter guide for pulverization of said liquid fuel, means for supplying fresh air to said combustion chamber, and at least one barrier unit arranged at the front edge of said combustion cylinder and projecting radially inwards, thereby blocking the flow out of said liquid fuel via said open front end of said combustion cylinder.

3. An improved liquid fuel burner comprising a hollow main body, a rotary main drive shaft concentrically arranged in said main body, an air supply duct coupled to said main body and surrounding said main drive shaft, a conical fuel carburetor coupled to the front end of said main drive shaft and surrounding said air supply duct, a scatter ring coupled to the rear end of said fuel carburetor whilst leaving scattering gaps for passage of liquid fuel, a hollow perforated combustion cylinder coupled to said main body and defining internally a combustion chamber around said fuel carburetor and externally a gas chamber surrounded by said main body, said combustion cylinder having an open front end and a front edge, means for supply liquid fuel to said combustion chamber, means for supplying fresh air to said combustion chamber, and at least one barrier unit arranged at said front edge of said combustion cylinder and projecting radially inwards, thereby blocking the flow out of said liquid fuel via said open front end of said combustion cylinder.

4. An improved liquid fuel burner as claimed in claim 1 or 2 in which each of said scatter guides takes the form of a nail raised radially outwards from said outermost conical wall and directed in the rotational direction of said scatter ring.

5. An improved liquid fuel burner as claimed in claim 1 or 2 in which each of said scatter guides takes the form of a substantially rectangular piece extending radially outwards from said outermost conical wall in the local tangential direction.

6. An improved liquid fuel burner as claimed in claim 1 or 2 in which each of said scatter guides takes the form of a substantially rectangular piece extending radially inwards from said outermost conical wall in the local tangential direction.

7. An improved liquid fuel burner as claimed in claim 1 or 2 in which said scatter guides includes a number of nails raised radially outwards from said outmost conical wall and directed in the rotational direction of said scatter ring, and a number of substantially rectangular pieces extending in local tangential directions, and said nails and pieces are arranged at alternate positions along said outmost conical wall.

8. An improved liquid fuel burner as claimed in claim 7 in which said pieces extend radially outwards.

9. An improved liquid fuel burner as claimed in claim 7 in which said pieces extend radially inwards.

10. An improved liquid fuel burner as claimed in claim 1 or 2 in which said scatter guides include a number of substantially rectangular pieces extending in local tangential directions, and said pieces extend alternately radially outwards and inwards.

11. An improved liquid fuel burner as claimed in claim 2 or 3 in which said barrier unit takes the form of an arcuate barrier arranged at said front edge of said combustion cylinder.

12. An improved liquid fuel burner as claimed in claim 11 in which the height of said barrier is uniform over its entire length.

13. An improved liquid fuel burner as claimed in claim 11 in which the height of said barrier diminishes on distal ends.

14. An improved liquid fuel burner as claimed in claim 2 or 3 in which said barrier unit includes an arcuate bent front edge of said main body which embraces said front edge of said combustion cylinder, which extends radially inwards.

15. An improved liquid fuel burner as claimed in claim 2 or 3 in which said barrier unit takes the form of an arcuate bulge formed at said front edge of said combustion cylinder, which projects radially inwards.

* * * * *

UNITED STATES PATENT AND TRADEMARK OFFICE

CERTIFICATE OF CORRECTION

PATENT NO. : 4,504,215

DATED : March 12, 1985

INVENTOR(S) : Junichiro Akiyama, et al.

It is certified that error appears in the above-identified patent and that said Letters Patent are hereby corrected as shown below:

Column 3, line 58, change "and" to --are--.

Column 4, line 58, change "guide" to --ring 80--.

Column 5, line 5, change "as" to --a--.

Column 6, line 60, change "9" to --90--.

Signed and Sealed this

*Twenty-third* Day of *July 1985*

[SEAL]

*Attest:*

DONALD J. QUIGG

*Attesting Officer* *Acting Commissioner of Patents and Trademarks*